US005375350A

United States Patent [19]

Maybon

[11] Patent Number: 5,375,350

[45] Date of Patent: Dec. 27, 1994

[54] EXCAVATING TOOL TOOTH

[75] Inventor: Guy Maybon, Saint Jorioz, France

[73] Assignee: Technogenia S.A., Saint Jorioz, France

[21] Appl. No.: 988,938

[22] PCT Filed: Sep. 18, 1991

[86] PCT No.: PCT/FR91/00735

§ 371 Date: Mar. 10, 1993

§ 102(e) Date: Mar. 10, 1993

[87] PCT Pub. No.: WO92/05320

PCT Pub. Date: Apr. 2, 1992

[30] Foreign Application Priority Data

Sep. 20, 1990 [FR] France ..... 90 11828

[51] Int. Cl.[5] ..... E02F 9/28; B22F 7/08

[52] U.S. Cl. ..... 37/460; 37/453; 37/195

[58] Field of Search ..... 37/460, 453, 452, 451, 37/446; 299/79; 172/772

[56] References Cited

U.S. PATENT DOCUMENTS

| | | | |
|---|---|---|---|
| 2,608,111 | 8/1952 | Ratkowski | 37/460 X |
| 2,718,162 | 9/1955 | Smith | 37/460 X |
| 3,286,379 | 11/1966 | Benetti | 37/460 X |
| 3,805,423 | 4/1974 | Engel et al. . | |
| 3,882,594 | 5/1975 | Jackson et al. | 37/460 X |
| 3,984,910 | 10/1976 | Helton et al. | 37/460 X |
| 4,052,802 | 10/1977 | Moen et al. | 37/460 |
| 4,187,626 | 2/1980 | Greer et al. | 37/453 |
| 4,715,450 | 12/1987 | Hallissy et al. | 37/460 X |
| 4,770,253 | 9/1988 | Hallissy et al. | 37/460 X |

FOREIGN PATENT DOCUMENTS

| | | |
|---|---|---|
| 2373500 | 7/1978 | France . |
| 62-99527 | 5/1987 | Japan . |

*Primary Examiner*—Randolph A. Reese
*Assistant Examiner*—Spencer Warnick
*Attorney, Agent, or Firm*—William H. Eilberg

[57] ABSTRACT

An excavating tool tooth includes a mounting area (10) and a working area (11). The working area (11) includes longitudinal bars (14–18) made of a hard material. The bars are inserted in the steel and snugly contact the tooth's cutting face. The presence of the rods made of a hard material substantially increases the tooth's service life. The bars are produced by infiltration.

16 Claims, 9 Drawing Sheets

EXCAVATING TOOL TOOTH

BACKGROUND OF THE INVENTION

The present invention relates to excavating tools such as revolving cutter head excavators for use in mines or dredgers.

Revolving cutter head excavators consist of a drive wheel that rotates around a shaft and is driven by a means of rotation. The periphery of the revolving cutter head excavator has a series of buckets equipped with teeth arranged in directions that are essentially radial. Dredgers do not have buckets and their teeth are distributed around the periphery in a rotary ogival structure. Each tooth consists of a single-unit tooth body structure made of a mechanically resistant metal or alloy such as steel, having a fixing area to connect it to the bucket or the ogival structure and a working area to dig the soil. The working area is generally flat and shaped like a shovel and is bounded by a leading face that points in the direction of movement of the periphery of the wheel or ogival structure in the preferred direction of rotation and a trailing face or face opposite the leading face. The leading face and the trailing face are generally flat or slightly curved and are connected by a front tapered facet that defines a transverse cutting edge. If the tooth is mounted on the bucket or the ogival structure, the transverse cutting edge is essentially parallel to the axis of rotation of the assembly and the general plane formed by the tooth shovel or working area generally slants in the direction of the direction of movement of the tooth in the preferred direction of rotation.

During operation, part of the peripheral zone of the bucket or cutter cuts into the ground, the transverse cutting edge of the teeth bites into the ground and the leading face pushes up the material. This results in considerable wear of the transverse cutting edge and the leading face.

One common solution to increase the service life and the efficiency of the teeth is to hardface the external surface of the leading face and the tapered front facet in order to cover them with a coat of molten carbide by fusing a welding bead.

Although this process significantly increases the service life of the tooth, wear still occurs, relatively slowly at the start of use when the hard material still covers the front facet; wear then becomes much faster when the hard material that covers the front facet is itself damaged by wear. The tooth can only be used as long as the length of its working area has not reduced too extensively and this defines the maximum permissible area of wear of the tooth.

In particular, as soon as the front facet has lost its protective coating of hard material, wear becomes much faster despite the existence of a layer of hard material on the leading face of the tooth.

Another drawback of known structures is that they require the use of a protective surface hardfacing, a layer that is produced by melting with a welding torch or an electric arc. An examples of such a layer comprises a deposit consisting of a mixture of molten carbide particles embedded in a fusible matrix. Such hardfacing is time consuming and awkward and produces relatively irregular surfaces made up by the juxtaposition of several side-by-side welding beads. The intermediate areas between two successive beads are usually sunken areas of which the metallurgical structure is slightly different from the central structure of the welding beads. This results in a lack of homogeneity of the material that forms the protective layer made of a hard material and this results in the appearance of preferential areas of wear, thus encouraging faster wear of the material. In addition, such a process is expensive and requires skilled labor.

Dredger teeth with a composite structure are known consisting of a metal tooth body containing inserts of a hard anti-abrasion material. In document U.S. Pat. No. 3,805,423, a prefabricated insert is fitted in appropriate recesses in the metal tooth body where it is fixed by welding or brazing. The insert, in the embodiment shown in FIGS. 3 and 4, consists of two intermediate bars which each take up half the height of the tooth. Document U.S. Pat. No. 4,052,802 also describes providing a prefabricated insert and fitting it in the tooth body. The insert is sandwiched between the metal surface plates, between which it is assembled by brazing. Therefore the insert does not take up the entire height of the tooth. There is no suggestion in this document of replacing the metal plates by a material containing particles of a hard material.

In document FR-A-2 373 500, an excavating tool is produced by providing cover plates made of sintered carbide on a steel body. The steel body is cast around the cover plates.

There is no suggestion in this document of replacing the internal steel body by a material containing particles of hard material. In any case, this results in an extremely fragile tooth.

The structures and production processes described in documents U.S. Pat. No. 4,052,802 and FR-A-2 373 500 are not compatible with each other. In fact, producing a tooth with an internal insert made of particles of hard material in accordance with document U.S. Pat. No. 4,052,802 is achieved by assembling several subassemblies by brazing whereas document FR-A-2 373 500 makes provision for such assembly by molding from a casting. The expert is therefore not encouraged to cosine the teachings of instruction in these two documents.

In document U.S. Pat. No. 3,286,379, fingers of hard material are produced by casting a hard material in longitudinal grooves in the metal tooth body. Document JP-A-62 99 527 describes a tooth for an excavating tool in which the prefabricated inserts are formed from sintered carbide and are assembled on the tooth body by brazing.

It seems that these known structures with longitudinal inserts do not give the expected results in terms of efficiency and long service life. In fact, fairly rapid wear is observed on the tooth, particularly due to flaking of the bars made of hard material. The bars of hard material which do not take up the entire height of the tooth do not provide a sufficient increase in the service life of the tooth and their manufacturing process does not allow sufficient cohesion of the components of such a heterogenous structure.

One of the main objects of the present invention is to avoid the disadvantages of known excavating tool teeth structures and their production processes; it initially proposes a new composite tooth structure consisting of several longitudinal bars of hard material that take up the entire height of the tooth. The new tooth structure is compatible with the presence of protective surface layers made of a molten hard material but can also be used without such a protective surface layer.

One of the problems is that, with usual brazing or welding processes, it is awkward or difficult to correctly insert and join bars that take up the entire height of the tooth without adversely affecting the mechanical properties of the anti-abrasion material that constitutes the bars. The invention solves this difficulty by using a new infiltration process on the tooth blank itself.

The invention suggests producing such a tooth structure by means of a so-called infiltration process. The infiltration process can be implemented in a relatively simple manner and does not require great skill on the part of the user, unlike hardfacing techniques using a welding bead, and also results in lower production costs. The process avoids the tricky operation of having to solder or braze an insert.

When such an infiltration process is used, the tooth structure thus obtained is characterized by the fact that the bars of hard material are bonded to the metal of the tooth body by a brazing alloy that forms the matrix which itself links the particles of hard material to each other. This feature seems particularly important in order to obtain satisfactory cohesion between the bars of hard material and the metal that forms the tooth body.

When using such an infiltration process, the mold structures are particularly small and easy to produce because the metal parts of the tooth structure themselves act as a mold.

The invention makes it possible to considerably improve the service life and efficiency of an excavating tool tooth to a surprising extent compared with familiar techniques given comparable quantities of hard material. The tooth continues to cut as it wears.

Finally, the risk of breakage or flaking of the coating and the bars of hard material is significantly reduced; this risk is often encountered with known teeth.

The invention therefore makes it possible to obtain better cohesion of the excavating tooth, improved hardness of the bars of hard material and greater ease of production.

SUMMARY OF THE INVENTION

In order to achieve these objects as well as others, the tooth for an excavating tool in accordance with the invention has a general structure that is similar to known teeth; however, the working area of the tooth according to the invention has bars consisting of a mixture based on particles of hard material bonded in a matrix, the said bars being embedded in the metal of the tooth body and forming longitudinal bars that are essentially perpendicular to the transverse cutting edge. The longitudinal bars made of hard material form a row of bars that are inserted into the interstices of a metal comb constituted by the rest of the structure of the body. In those parts of the cross section that contain longitudinal bars with particles of hard material, the material with particles of hard material ideally takes up the entire height of the tooth between the leading face and the trailing face.

In one possible embodiment, the longitudinal bars of hard material are separated from the front facet by a metal area or metal crosspiece. This structure makes it easy to produce the tooth by infiltration because the metal crosspiece then forms part of the mould to contain the molten material intended to form the bars.

In one particular embodiment, the longitudinal bars made of hard material are linked to each other by bridges of hard material of which the height is less than that of the bars and with which they form a plate of hard material that constitutes the central part of the leading face. In this case, the front ends of the bars made of hard material can usefully be joined to each other by a crosspiece made of a hard material of which the height is essentially equal to the height of the bars.

Further objects, characteristics and advantages of the present invention will be apparent from the following description of particular embodiments, reference being made to the accompanying drawings.

DETAILED DESCRIPTION OF THE INVENTION

Figure 1:
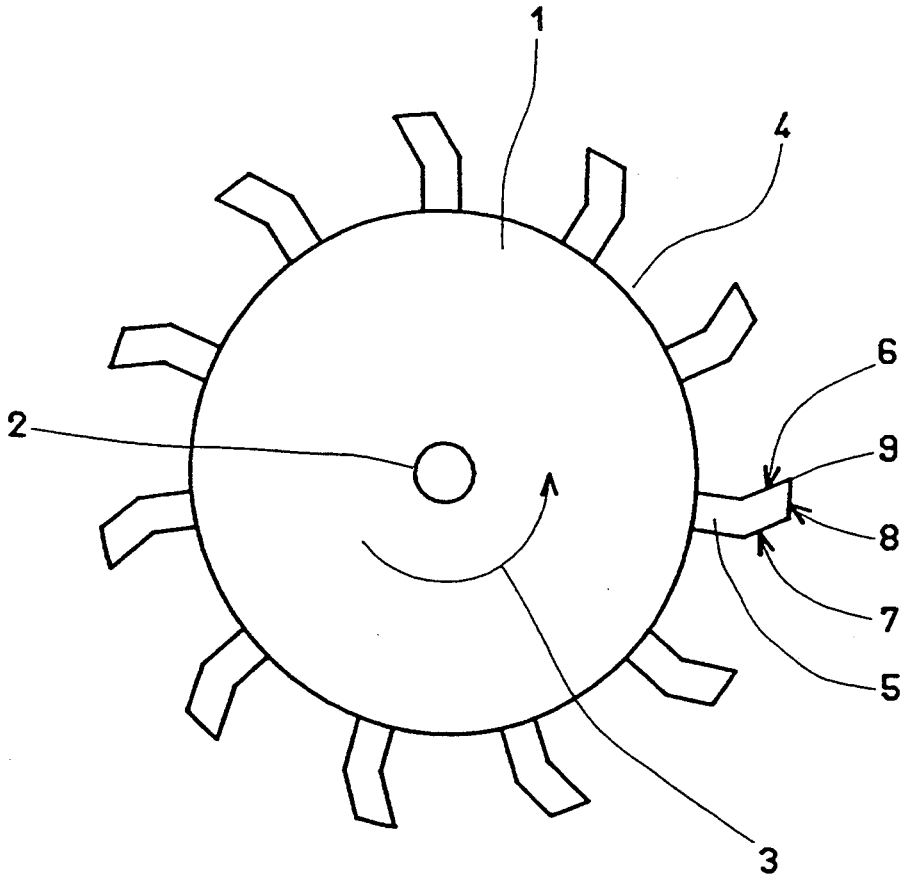
FIG. 1 is a diagrammatic cross section of a dredger.

In the embodiment diagrammatically shown in FIG. 1, an excavating tool such as a dredger or a revolving cutter head excavator for use in a mine generally consists of a rotating carrier structure 1 mounted so that it rotates on a drive shaft 2 and is driven by means of rotation around a preferred axis of rotation represented by arrow 3. The periphery 4 of the rotating carrier structure is fitted with teeth such as tooth 5 pointing in generally radial directions facing slightly in the direction of preferred direction of rotation 3 as shown in the Figure. The teeth are all normally identical. Tooth 5 consists of a leading face 6 pointing towards the preferred direction of rotation 3, an opposite trailing face 7 and a front facet 8 that defines a transverse cutting edge 9. Transverse cutting edge 9 is essentially parallel to the axis of rotation 2 of the wheel.

Figure 2:
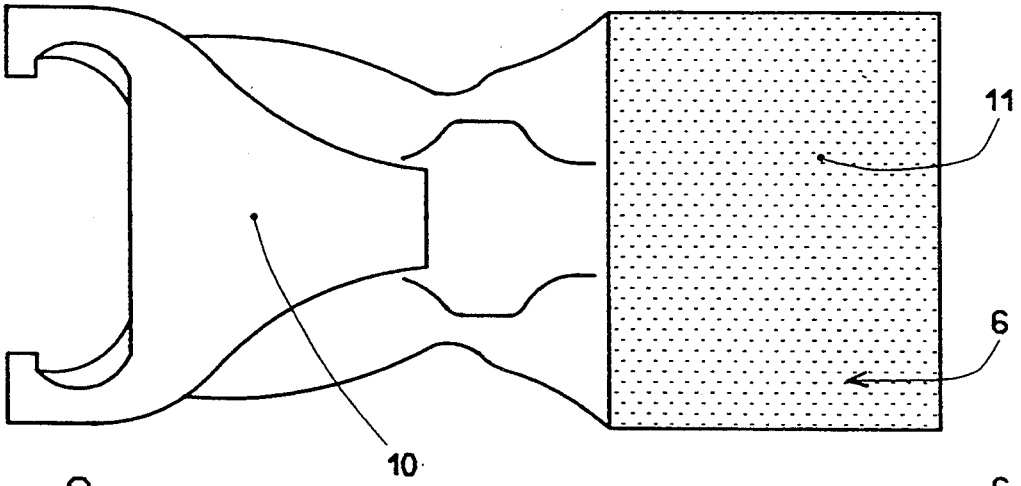
FIG. 2 is a top view of a tooth showing the leading face.
Figure 3:
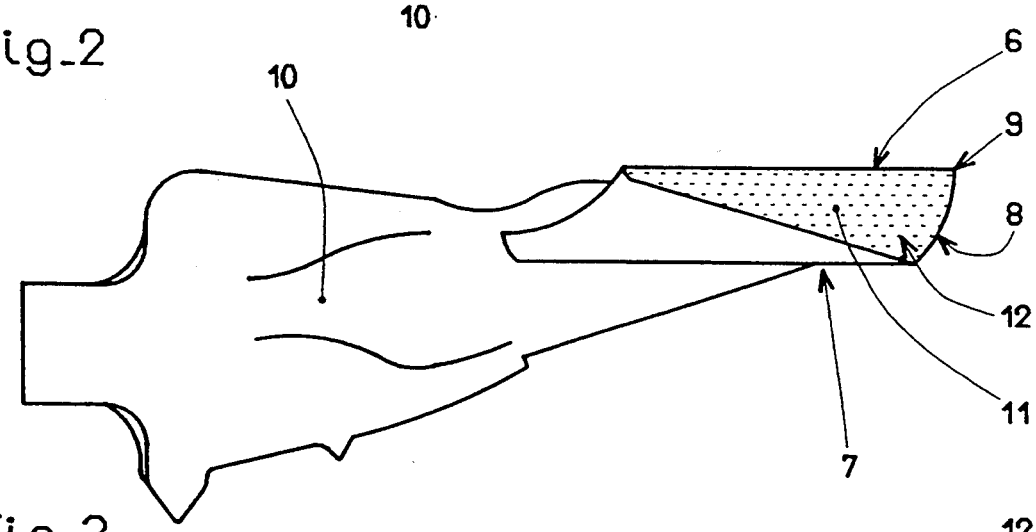
FIG. 3 is a side view of the tooth in FIG. 2.
Figure 4:
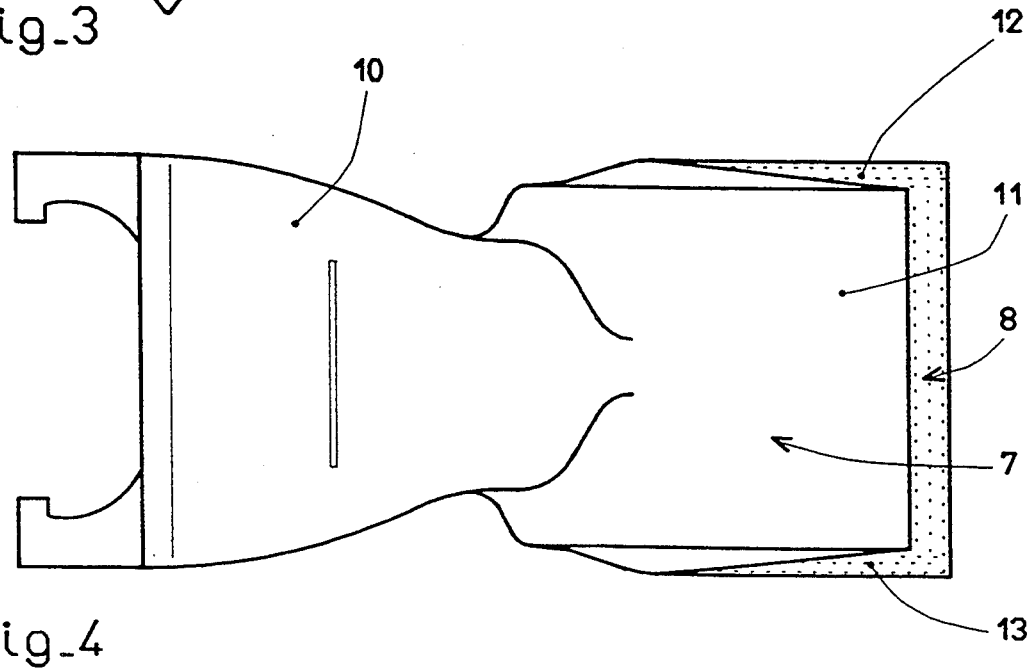
FIG. 4 is a bottom view of the tooth in FIG. 2 showing the trailing face.

Tooth 5 is shown in greater detail in FIGS. 2 to 4. FIGS. 2 to 4 only show the outer surface of the tooth which can be a traditional tooth or a tooth in accordance with the present invention.

As shown in FIGS. 2 to 4, a tooth of an excavating tool in accordance with the invention consists of a tooth body structure made of a mechanically resistant metal or alloy such as steel having a fixing area 10 to join it to the drive wheel structure and a working area 11 to dig the soil. Fixing area 10 can be of the traditional type and has no special effect as far as the present invention is concerned. The invention deals with working area 11.

Working area 11 is generally flat, shaped like a shovel and limited by leading face 6, trailing face 7, front facet 8 and two lateral edges 12 and 13. Leading face 6 and trailing face 7 are generally flat, slightly curved and, if applicable, parallel to each other. Front facet 8 is tapered. The tooth therefore has a transverse cutting edge 9.

Traditional teeth generally have coating layers made of a hard material such as layers based on particles of molten tungsten carbide embedded in a metal matrix. Leading face 6, front facet 8 and lateral edges 12 and 13 are covered in a protective layer of hard material.

Figure 5:
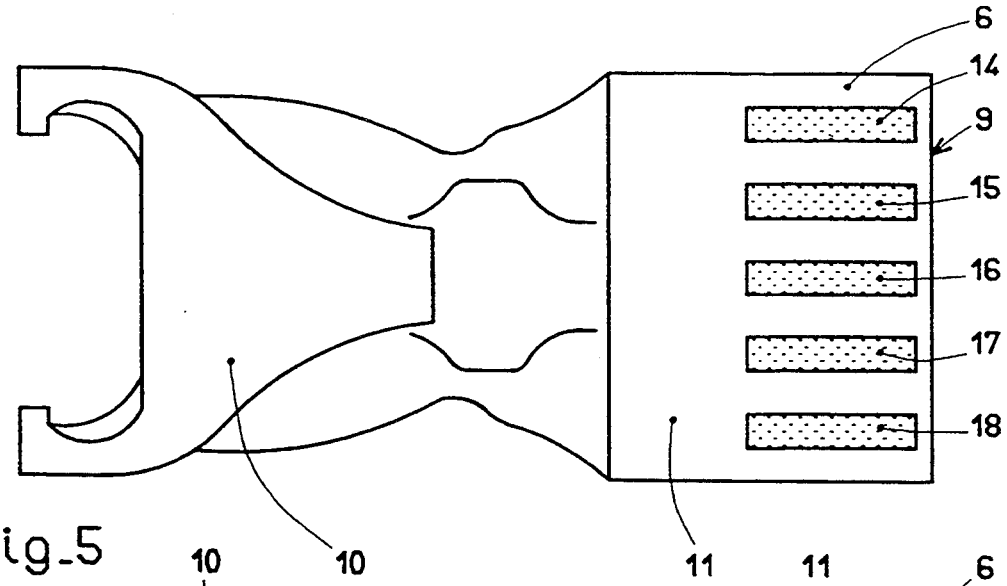
FIGS. 5 to 7 show the leading face, a profile view and the trailing face of a tooth respectively in another embodiment of the invention.

The structure according to the invention is characterised in particular by the presence and the shape of the areas of hard material embedded in the metal structure of working area 11. Such areas of hard material are apparent, for example, in the embodiment on FIGS. 5 to 7: FIG. 5 shows, on leading face 6, five rectangular areas 14, 15, 16, 17 and 18 respectively. The hard material consisting of a mixture based on particles of hard material bonded in a matrix just shows on the surface of leading face 6 in the five rectangular areas which are regularly spaced relative to each other and have longitudinal axes. The rectangular areas are close to transverse cutting edge 9 but nevertheless do not touch the cutting edge. Likewise, similar rectangular areas 19, 20, 21, 22 and 23 on trailing face 7 are shown in FIG. 7. In reality, the respective areas such as area 17 in FIG. 5 and area 22 in FIG. 7 are the exposed faces of a bar 24 (FIG. 8) consisting of a hard material inserted in a slot that crosses the metal forming the base structure of working area 11.

Figure 6:
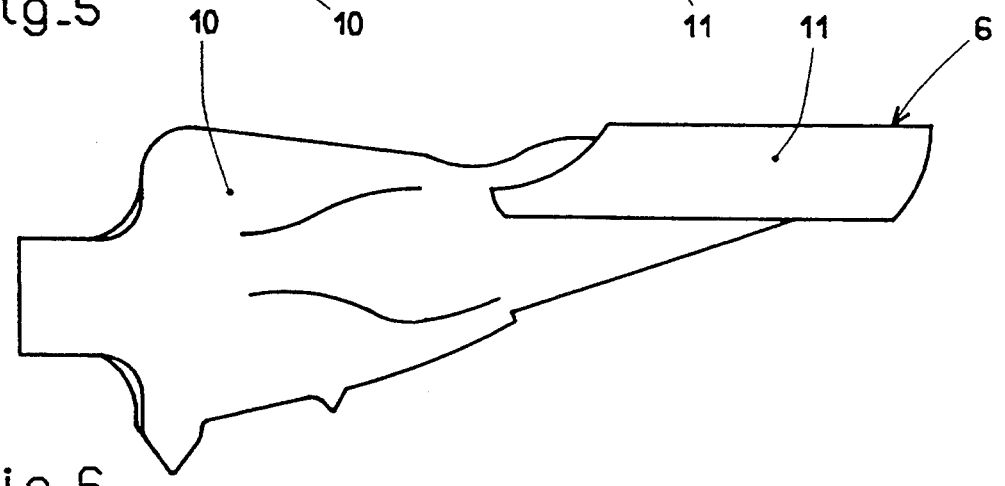
Figure 7:
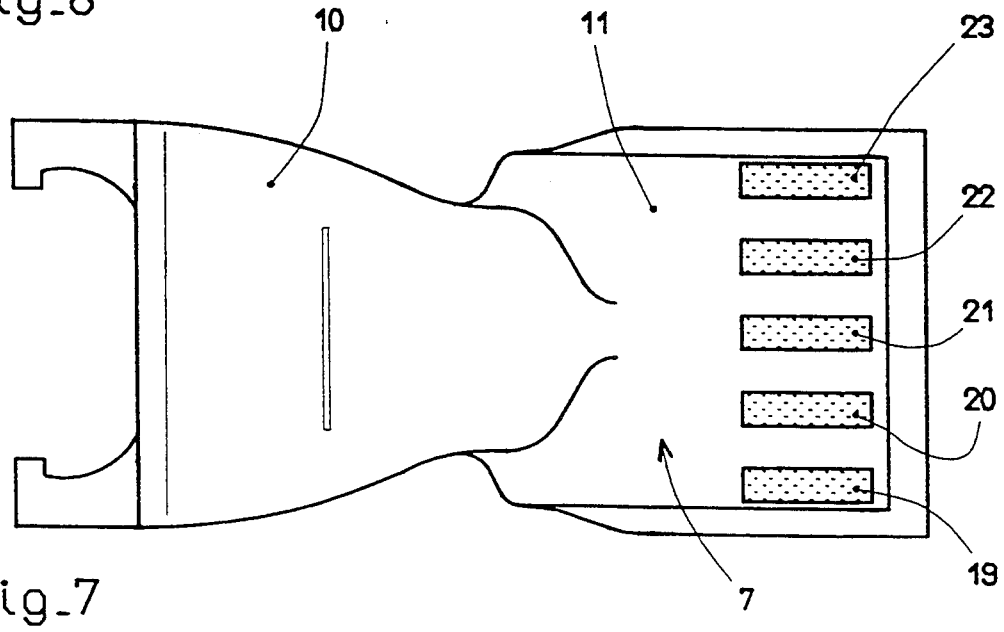
Figure 8:
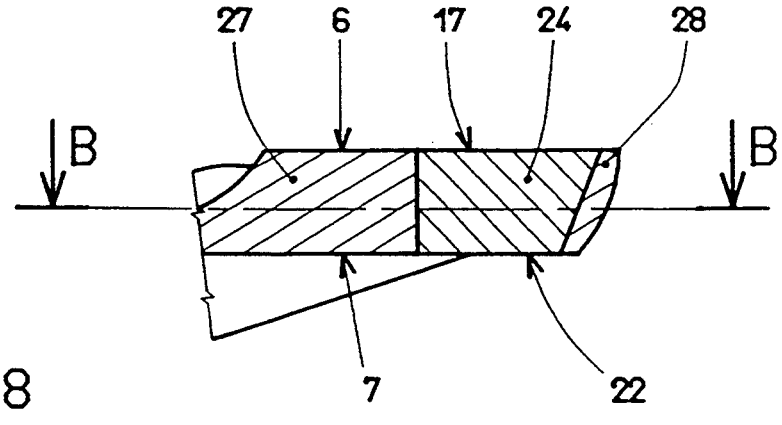
FIG. 8 is a longitudinal cross section along plane A—A in FIG. 9.
Figure 9:
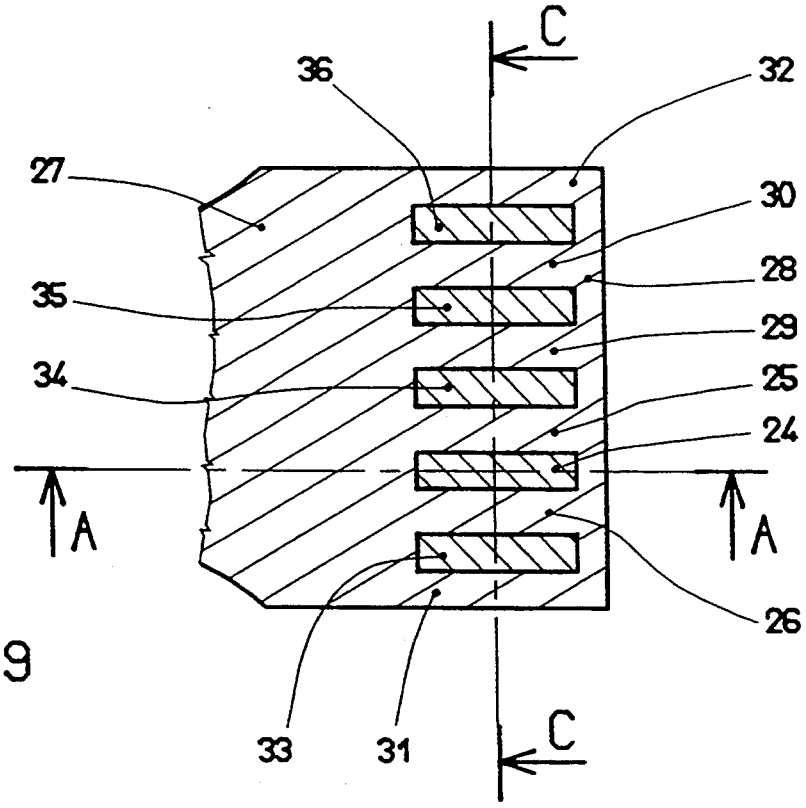
FIG. 9 is a top view of the tooth in FIG. 5, a longitudinal cross section along plane B—B in FIG. 8.
Figure 10:
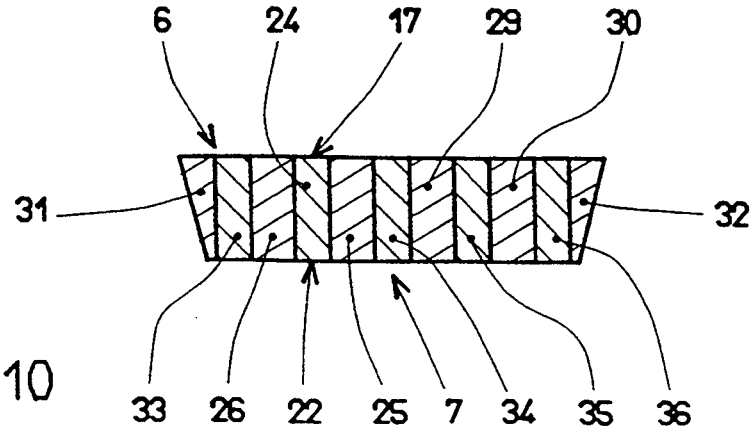
FIG. 10 is a cross section along plane C—C in FIG. 9.

FIGS. 8 to 10 show various cross sections and longitudinal sections of the tooth in FIGS. 5 to 7. FIG. 8 is a longitudinal section along a plane that is perpendicular to leading face 6 and bisects the bar made of hard material 24 in FIG. 9 corresponding to surfaces 17 in FIG. 5 and 22 in FIG. 7. The hard material of bar 24 is laterally limited by two intermediate metal spars 25 and 26, by the base 27 of the working area metal structure and by an end metal crosspiece 28. The material of bar 24 is apparent on leading face 6 to form rectangular area 17 and is apparent on trailing face 7 to form rectangular area 22.

In this embodiment, the working area metal part 11 has a series of longitudinal slots separated by spars, for example six spars 25, 26, 29, 30, 31 and 32 which define five slots to accommodate five bars 24, 33, 34, 35 and 36. The longitudinal slots are filled with anti-abrasion hard material such as tungsten carbide or the like. The metal spars are all linked on the one hand to the base of metal structure 27 and, on the other hand, to front metal crosspiece 28.

In this embodiment, the outer faces of the tooth are not covered in a protective anti-wear layer based on a hard material. The presence of internal areas of hard material such as bar 24 is sufficient to delay wear of the tooth considerably.

Figure 11:
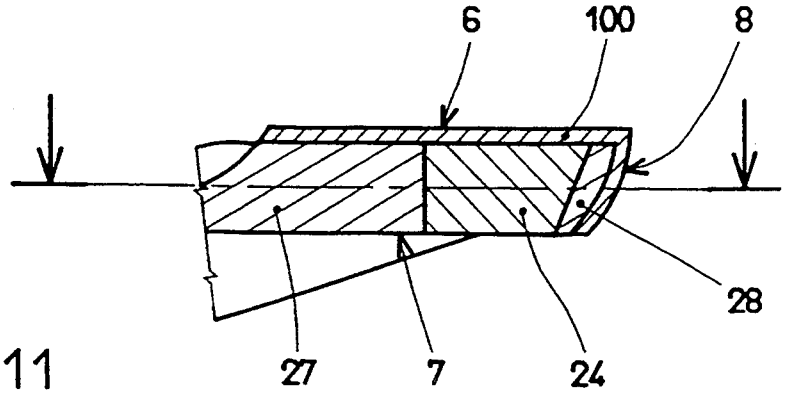
FIGS. 11, 12 and 13 are views similar to FIGS. 8, 9 and 10 respectively in a second embodiment of the invention.
Figure 12:
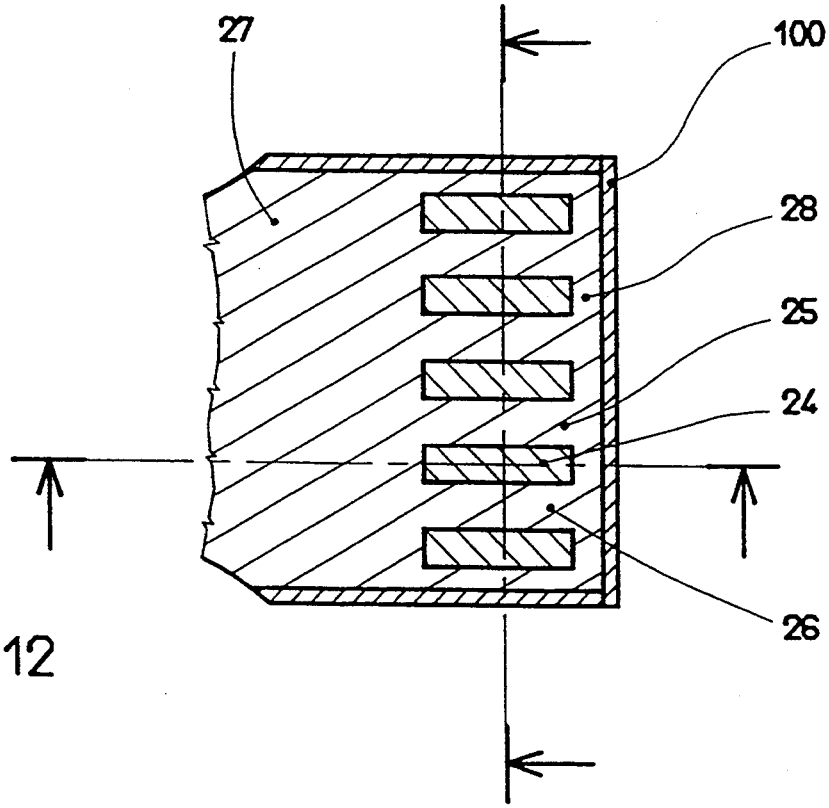
Figure 13:
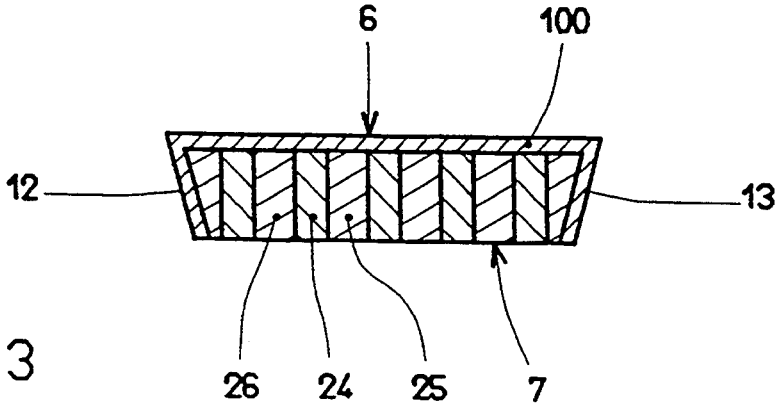

The structure shown in FIGS. 11 to 13 is similar to that in FIGS. 8 to 10: the internal structure is identical; the only difference is the presence of an external protective layer 100 of hard material such as particles of molten tungsten carbide bonded by a metal matrix, the external surface of the said protective layer forming the leading face 6, the front facet 8 and the lateral edges 12 and 13. The external appearance of such a tooth is identical to that shown in FIGS. 2 to 4.

Figure 14:
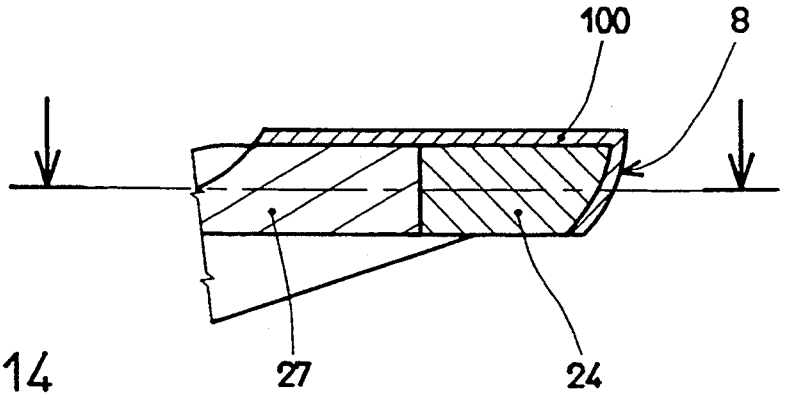
FIGS. 14, 15 and 16 are views similar to FIGS. 8, 9 and 10 in a third embodiment of the invention.
Figure 15:
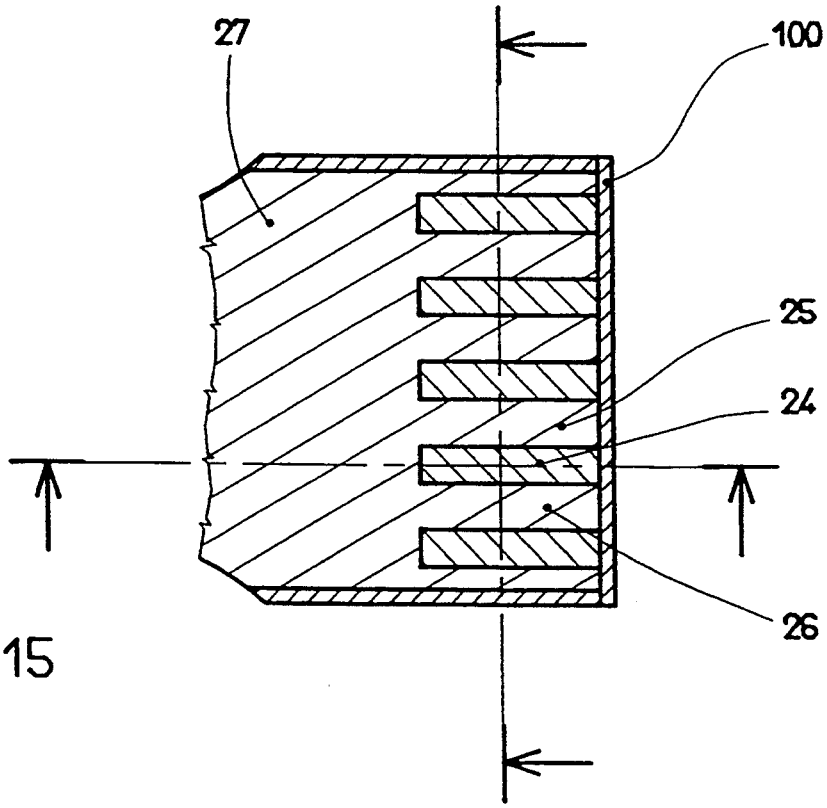
Figure 16:
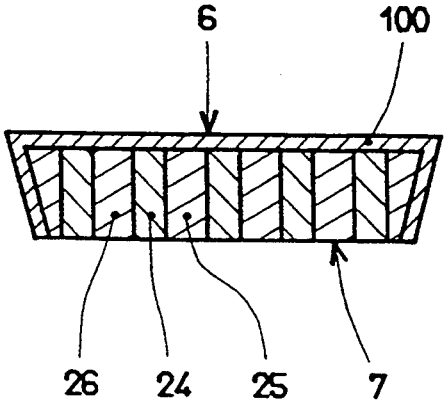

The embodiment shown in FIGS. 14 to 16 is similar to that in FIGS. 11 to 13 and only differs from it in that metal crosspiece 28 has been omitted. In this case, the metal spars such as spars 25 and 26 have front ends that are free and are not joined and space 24 is an open slot. The metal spars therefore form a kind of comb of which the interstices are occupied by a row of bars made of hard material. The hard material that fills the interstices such as space 24 extends as far as protective layer 100 of which the external surface forms front cutting facet 8. As an alternative, one can use the same internal tooth structure without external protective layer 100.

Figure 17:
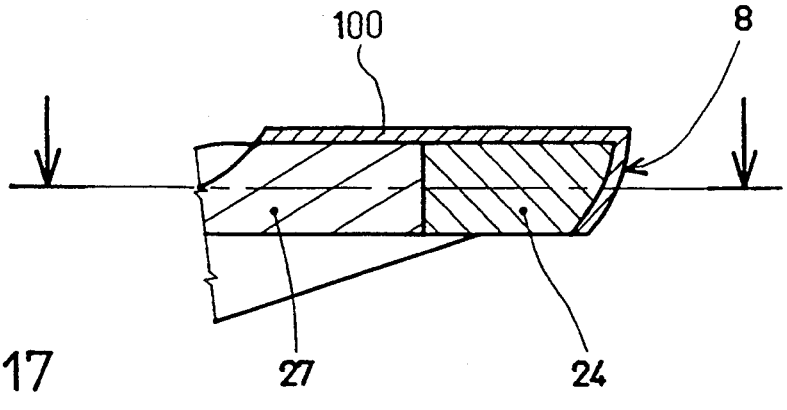
FIGS. 17, 18 and 19 are views similar to FIGS. 8, 9 and 10 respectively in a third embodiment of the invention.
Figure 18:
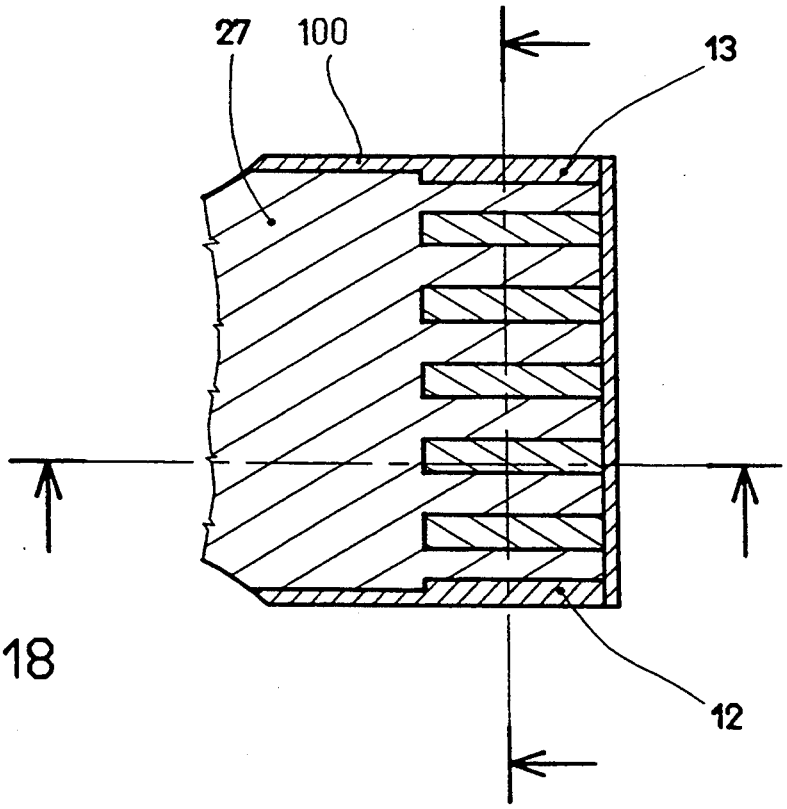
Figure 19:
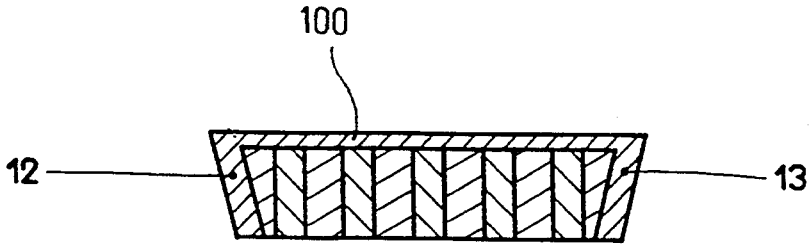

In the embodiment in FIGS. 17 to 19, the structure is similar to that in the embodiment in FIGS. 14 to 16. It differs from it in that, in the front area of lateral edges 12 and 13, the thickness of protective layer 100 made of hard material is increased. These areas are actually preferred areas of wear that are subjected to wear stresses that exceed those to which the other working parts of the tooth are subjected. It has been observed that a slight increase in the thickness of the protective layer in both these lateral parts results in a significant increase in the service life of the tooth.

Figure 20:
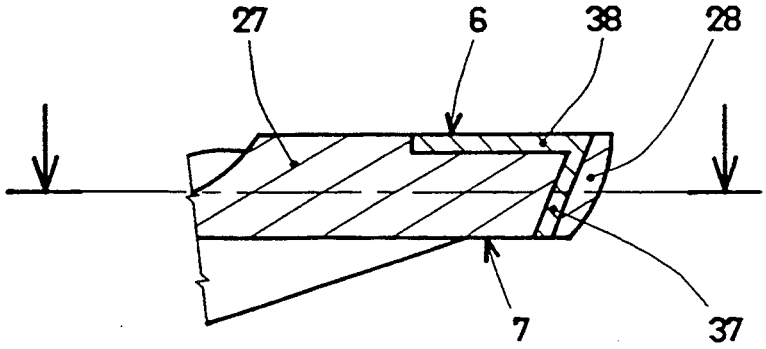
Figure 21:
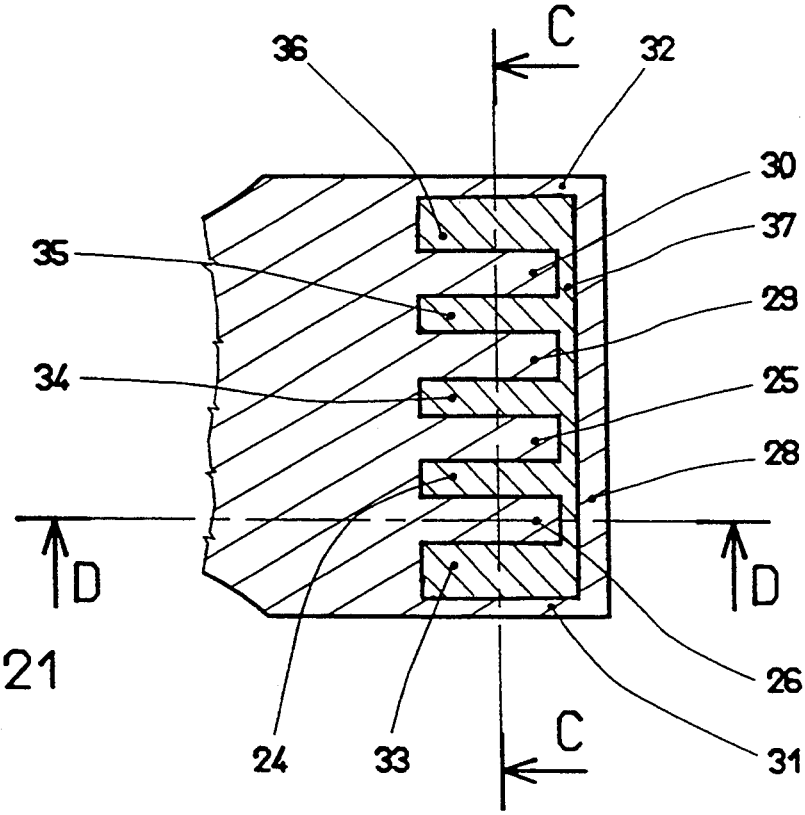
FIGS. 21 and 22 are views similar to FIGS. 9 and 10 respectively in a fourth embodiment of the invention with FIG. 20 being a longitudinal cross section along plane D—D in FIG. 21.
Figure 22:
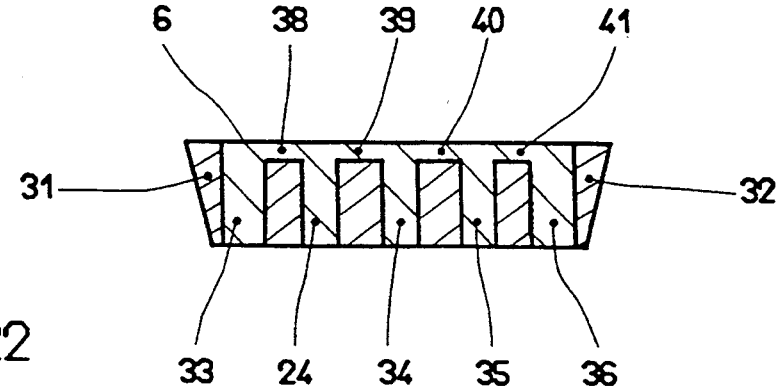

The embodiment shogun in FIGS. 20 to 22 differs from the above embodiments in that bridges of hard material are provided in order to link the successive internal bars made of hard material of the tooth. As in the embodiment in FIGS. 8 to 10, the metal structure of the tooth consists of a metal base 27 to which intermediate spars 25, 26, 29 and 30 are connected as well as two lateral spars 31 and 32. The front ends of lateral spars 31 and 32 are linked by metal crosspiece 28. Intermediate metal spars 25, 26, 29 and 30 have free front ends that are offset from metal crosspiece 28. The hard material thus forms longitudinal bars 24, 33, 34, 35 and 36 and the front ends of the bars are linked to each other by a crosspiece 37 made of hard material. Crosspiece 37 made of hard material can ideally take up the entire height of the working part of the tooth, i.e. the entire distance separating leading face 6 and trailing face 7 as shown in FIG. 20. In this case, during use, metal crosspiece 28 wears out fairly quickly and exposes crosspiece 37 made of hard material which counteracts wear. Similarly, metal lateral spars 31 and 32 wear out fairly quickly and then expose lateral bars 33 and 36 made of hard material which counteract wear.

In this same embodiment, longitudinal bars made of hard material are linked to each other by bridges of hard material of which the height is less than that of the bars and with which they form a plate of hard material that constitutes the central part of leading face 6. As shown in FIG. 22 in a cross section, longitudinal bars 24 and 33 made of hard material are linked by bridge 38. FIG. 20 is a longitudinal section along plane D—D in FIG. 21 and shows a longitudinal section of this same bridge 38. Bridges 39, 40 and 41 link the other longitudinal bars made of hard material two by two. In other words, the height oil the intermediate metal spars is less than the total height of the working part of the tooth so that the hard material covers intermediate longitudinal bars on the leading face 6 of the tooth.

In all the embodiments described above, the bars made of hard material can be approximately 4 to 15 mm thick and can be separated by metal areas or metal spars that are roughly 4 to 15 mm thick. The thickness is defined as the dimension in a direction parallel to transverse cutting edge 9. The length of the bars of hard material is essentially equal to the length of the maximum permissible area of wear of the tooth. The hard material that forms the longitudinal bars can ideally contain particles of molten tungsten carbide, preferably spheroidal particles with no sharp-angle areas. Improved anti-wear characteristics are obtained by using a mixture of particles of different sizes, some particles of molten tungsten carbide having a diameter equal to or greater than 2 mm.

Figure 23:
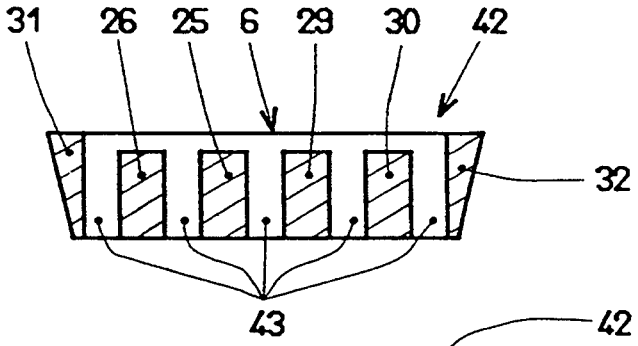
FIGS. 23 to 27 illustrate the stages in a process to produce teeth in accordance with the invention by infiltration.
Figure 24:
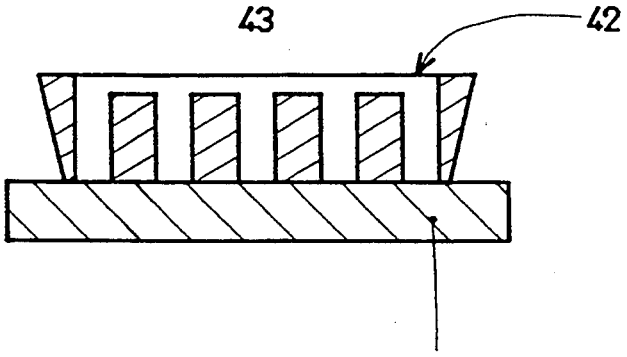
Figure 25:
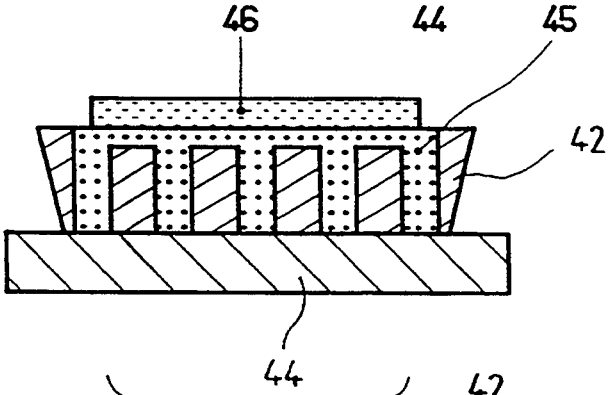
Figure 26:
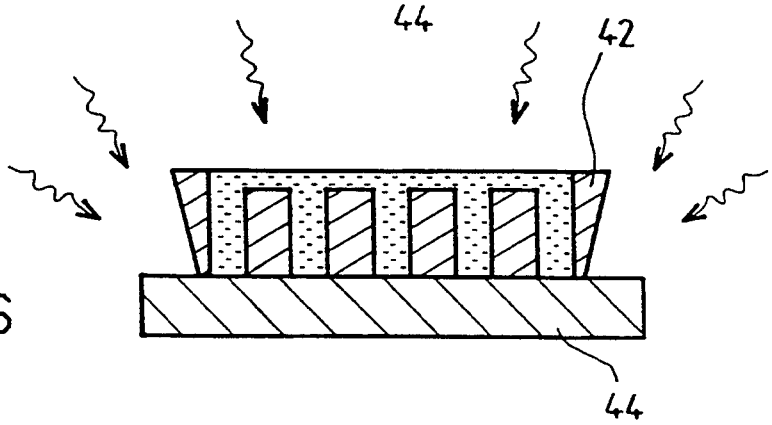
Figure 27:
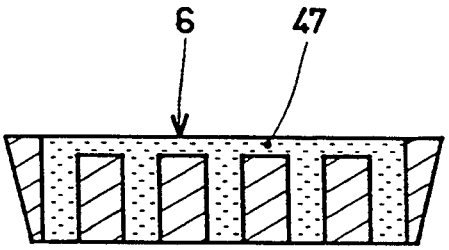

In accordance with the invention, the preferred process shown in FIGS. 23 to 27 to produce internal areas of hard material such as the longitudinal bars, comprises the following steps:

a) According to FIG. 23, produce a blank 42 made of metal or alloy having a fixing area 10 and a working area metal part 11, the said working area metal part consisting of a series of longitudinal slots 43 that terminate at least on leading face 6 and are separated by spars 25, 26, 29, 30, 31, 32;

b) According to FIG. 24, place the said blank 42 on a mounting 44 with its leading face 6 upwards and in an essentially horizontal direction;

c) According to FIG. 25, fill the said longitudinal slots 43 with particles of a hard anti-abrasion material 45 such as molten tungsten carbide or the like and vibrate this assembly so that the particles are in as close as possible contact with the walls of the slots and are contiguous to each other;

d) According to FIG. 25, prepare a sufficient quantity of an appropriate alloy 46 in a form suitable to ensure subsequent distribution of the alloy during a subsequent melting phase, the alloy being a brazing alloy capable of wetting the particles of hard material 45 and the material which forms blank 42 and of melting at a temperature less than the melting temperature of blank 42 and mounting 44;

e) According to FIG. 26, heat this assembly to a temperature higher than the melting point of alloy 46 and lower than the melting point of blank 42 and mounting 44 in order to ensure infiltration of the molten alloy between the particles of hard material 45;

f) According to FIG. 27, allow to cool and separate the piece thus obtained from its mounting.

In the embodiment described with reference to FIGS. 23 to 27, blank 42 is such that intermediate metal spars 25, 26, 29 and 30 are offset from leading face 6 which is defined by outer spars 31 and 32. In this way, during the filling and infiltration stage in FIG. 25, hard material 45 fills slots 43 and covers intermediate spars 25, 26, 29 and 30 in order to produce a plate of infiltrated hard material 47 which is shown in FIG. 27 and forms the central area of leading face 6.

According to one variation, front ends of outer spars 31 and 32 are linked to each other by a metal crosspiece such as crosspiece 28 shown in FIG. 20 whereas intermediate spars 25, 26, 29 and 30 have a free end which is separated from crosspiece 28 by a gap. In this way, during the filling and infiltration stage illustrated in FIG. 25, hard material 45 fills the said gap which separates the free ends of the intermediate spars and metal crosspiece 28 in order to form a crosspiece 37 of hard material such as that shown in FIGS. 20 and 21.

This process is compatible with a subsequent stage during which one can produce a surface coating 100 of hard material on leading face 6 and front facet 8 as shown in FIGS. 11 to 16. Surface coating 100 of hard material can, for instance, be produced by fusing a welding bead with a welding torch or electric arc using conventional hardfacing processes by welding.

In order to improve the cohesion between the tooth body metal structure and the parts made of hard material, one can carry out, before infiltration and welding, an initial operation to prepare the surface of the blank which is in contact with the hard material. Such preparation may include the following phases:

Grinding or shot blasting of the surface,

Plating of a thin film of alloy of the self-fusing nickel-chrome-boron-silicon type by means of a welding torch.

The present invention is not confined to the embodiments explicitly described and it includes the various variations and generalizations contained in the scope of the invention as defined in the appended claims. In particular, one can, without exceeding the scope of the invention, provide a number of bars of hard material other than five, bars having cross sections other than a rectangular cross section and shapes of the leading and trailing tooth face which are not flat.

I claim:

1. Tooth for excavating tool comprising a tooth body structure made of a mechanically resistant metal or alloy having a fixing area (10) to join said tooth to a drive structure (1) and a working area (11) to dig the soil, the working area (11) being limited by a leading face (6) and a trailing face (7) which are connected by a front tapered facet (8) that defines a transverse cutting edge (9), the working area (11) having a row of bars (24, 33, 34, 35, 36) made of a mixture based on particles of hard material bonded in a matrix, said bars being longitudinal and essentially perpendicular to said transverse cutting edge (9) and forming a row of bars inserted in the interstices of a metal comb with several metal or alloy spars (25, 26, 29, 30, 31, 32) made up by a remainder of the body structure, characterized in that, in those parts of the cross section that include longitudinal bars made of particles of hard material (24, 33, 34, 35, 36), the bars with particles of hard material take up an entire height of the tooth between the leading face (6) and the trailing face (7).

2. Tooth according to claim 1, characterized in that the longitudinal bars made of a mixture used on particles of hard material (24, 33, 34, 35, 36) are separated from the front facet (8) by a metal crosspiece (28).

3. Tooth according to claim 2, characterized in that the longitudinal bars made of a mixture based on particles of hard material (24, 33, 34, 35, 36) are linked to each other by bridges of hard material (38, 39, 40, 41), the bridges having a height, the height of the bridges is less than that of the bars, wherein said longitudinal bars form a plate of hard material (47) which constitutes the central part of the leading face (6).

4. Tooth according to claim 3, characterized in that the front ends of the bars of hard material (24, 33, 34, 35, 36) are joined to each other by a crosspiece made of hard material (37) the height of which essentially equals the height of the bars.

5. Tooth according to claim 1, characterized in that the bars made of a mixture based on particles of hard material (24, 33, 34, 35, 36) are roughly 4 to 15 mm thick and are separated by metal or alloy spars (25, 26, 29, 30) which are roughly 4 to 15 mm thick.

6. Tooth according to claim 1, characterized in that the bars made of a mixture based on particles of hard material (24, 33, 34, 35, 36) are essentially as long as a length of the maximum permissible area of wear of the tooth.

7. Tooth according to claim 1, characterized in that the leading face (6) and front facet (8) of said working area and lateral edges (12, 13) of said tooth are covered in a layer (100) of material based on particles of hard material bonded in a matrix.

8. Tooth according to claim 1, characterized in that the longitudinal bars made of a mixture based on particles of hard material (24, 33, 34, 35, 36) contain particles of molten tungsten carbide.

9. Tooth according to claim 8, characterized in that some of the particles of molten tungsten carbide have a diameter equal to or greater than 2 mm.

10. Tooth according to claim 1, characterized in that the bars made of a mixture based on particles of hard material (24, 33, 34, 35, 36) are bonded to the metal of the tooth body structure by a brazing alloy forming the matrix that links the particles of hard material.

11. Process to produce a tooth for an excavating tool of the type consisting of a tooth body structure made of metal or alloy which is mechanically resistant having a fixing area (10) to join it to a drive structure (1) and a working area (11) to dig the soil, the working area being limited by a leading face (6) and a trailing face (7) which are connected by a tapered front facet (8) defining a transverse cutting edge (9), the working area having bars (24, 33, 34, 35, 36) made of a mixture based on particles of hard material bonded in a matrix, said bars being embedded in the metal of the tooth body and forming longitudinal bars that are essentially perpendicular to said transverse cutting edge (9), said process being characterized in that it comprises the following steps:

a) producing a blank (42) made of metal or alloy having the fixing area (10) and the working area (11), said working area having a series of longitudinal slots (43) opening out into said leading face (6) and said trailing face (7) and separated by spars (25, 26, 29, 30, 31, 32);

b) placing the blank (42) on a mounting (44) with its leading face (6) upwards so that said blank is essentially horizontal;

c) filling said longitudinal slots (43) with particles of a hard anti-abrasion material (45) such as molten tungsten carbide vibrating the blank and the mounting so that the particles are in as close as possible contact with the walls of the slots and are contiguous with each other;

d) preparing a sufficient quantity of a brazing alloy (46) which has a melting temperature less than the melting point of the blank (42) and the mounting (44);

e) heating the blank, the mounting and the brazing alloy to a temperature higher than the melting temperature of the brazing alloy (46) and lower than the melting point of the blank (42) and the mounting (44) in order to create a molten brazing alloy and to ensure the infiltrating of the molten brazing alloy between the particles of hard material to wet the particles of hard material and the metal or alloy which forms the blank and the mounting; and f) allowing the blank and the mounting to cool and separating a finished piece from the mounting.

12. Process according to claim 1, characterized in that the process includes an initial operation to prepare the surface of the blank which is in contact with the hard material, the initial operation consisting of the following phases:

grinding the surface, plating the surface with a thin film of alloy of the self-fusing nickel-chrome-boron-silicon type by means of a welding torch.

13. Process according to claim 11, characterized in that:

the blank (42) is such that the intermediate metal spars (25, 26, 29, 30) are offset from leading face (6) defined by the outer spars (31, 32), during the filling and infiltration stage, the hard material (45) fills the slots (43) and covers the intermediate spars to make a plate of infiltrated hard material (47) forming the central area of leading face (6).

14. Process according to claim 13, characterized in that:

the front ends of the outer spars (31, 32) are linked to each other by a metal crosspiece (28) whereas the intermediate spars (25, 26, 29, 30) have a free end that is separated from the metal crosspiece (28) by a gap, during the filling and infiltration phase, the hard material (45) fills the said gap separating the free ends of the intermediate spars and the metal crosspiece (28) to form a crosspiece of hard material (37).

15. Process according to claim 11, characterized in that the process includes a subsequent stage to produce a surface coating (100) of hard material that covers, in particular, the leading face (6) and the front facet (8).

16. Process according to claim 11, characterized in that the process includes an initial operation to prepare the surface of the blank which is in contact with the hard material, this preparation stage consisting of the following phases:

shot blasting the surface, plating the surface with a thin film of alloy of the self-fusing nickel-chrome-boron-silicon type by means of a welding torch.

* * * * *